US006568026B2

(12) United States Patent
Roy et al.

(10) Patent No.: US 6,568,026 B2
(45) Date of Patent: May 27, 2003

(54) PORTABLE BACK PACK VACUUM

(76) Inventors: Lawrence Michael Roy, 313 Edward J St., Clinton, MI (US) 49236-9741; Daniel Roy, 313 Edward J St., Clinton, MI (US) 49236-9741

( * ) Notice: Subject to any disclaimer, the term of this patent is extended or adjusted under 35 U.S.C. 154(b) by 0 days.

(21) Appl. No.: 09/968,658

(22) Filed: Oct. 1, 2001

(65) Prior Publication Data

US 2003/0070250 A1 Apr. 17, 2003

(51) Int. Cl.[7] ..... A47L 5/36
(52) U.S. Cl. ..... 15/327.5; 15/323
(58) Field of Search ..... 15/323, 327.5

(56) References Cited

U.S. PATENT DOCUMENTS 1,047,164 A * 12/1912 Butenschoen ..... 15/327.5
3,286,446 A * 11/1966 Happe et al. ..... 15/327.5
4,541,142 A * 9/1985 Pudwill ..... 15/323
4,748,712 A * 6/1988 DiGiovanni ..... 15/327.5
5,267,371 A * 12/1993 Soler et al. ..... 15/327.5
6,295,692 B1 * 10/2001 Shideler ..... 15/327.5
6,393,656 B1 * 5/2002 Paterson et al. ..... 15/327.5

OTHER PUBLICATIONS

"A terrific belt for shop vacs", Wood Magazine, p. 32, Aug. 1995.*

* cited by examiner

*Primary Examiner*—Terrence R. Till
(74) *Attorney, Agent, or Firm*—Michael I Kroll

(57) ABSTRACT

The present invention 10 discloses a portable back pack vacuum consisting of a housing 12 containing vacuum components. Shoulder straps 22 and a waist belt 16 with buckle 17 are provided for easy maneuvering of the device. A hose storage compartment 28 allows the user to stow the vacuum hose 30 while not in use. The waist belt provides multiple elastic pockets 18 for easy storage and accessibility to items and attachments 20 for the device. A handle 24 is located at the top of the device for easy lifting assistance.

13 Claims, 13 Drawing Sheets

PORTABLE BACK PACK VACUUM

BACKGROUND OF THE INVENTION

Field of the Invention

The present invention relates generally to Vacuum cleaners and more specifically to a portable back pack vacuum consisting of a housing containing vacuum components and is electrically operated and can be carried within a range of twenty-five feet from where the device is plugged in. Shoulder straps and a waist belt are provided for easy maneuvering of the device. An extension tube storage compartment allows the user to stow the vacuum hose while not in use. The waist belt provides elastic pockets for easy storage and accessibility to items and attachments for the device. A handle is located at the top of the device for easy lifting assistance. A removable, tinted, transparent, plastic filter canister is provided. It is attached to the upper portion of the device by means of locking clips. The canister is removed to access the reusable filter and discard consumption within the canister. A hose storage compartment is provided and allows the user a place to stow the hose while not in use. The hose is attached to the device at one distal end by means of a swivel base. The swivel base allows the hose to rotate in any direction the hose needs to be manipulated. The device is provided in commercial, residential and pro series.

SUMMARY OF THE PRESENT INVENTION

The present invention discloses a portable back pack vacuum consisting of a housing containing vacuum components. Shoulder straps and a waist belt with buckle are provided for easy maneuvering of the device. A hose storage compartment allows the user to stow the vacuum hose while not in use. The waist belt provides multiple elastic pockets for easy storage and accessibility to items and attachments for the device. A handle is located at the top of the device for easy lifting assistance.

A primary object of the present invention is to provide a back packable vacuum.

Another object of the present invention is to provide a back packable vacuum that is electrically operated.

Yet another object of the present invention is to provide a back packable vacuum that can be carried twenty-five feet from the area it is plugged into.

Still yet another object of the present invention is to provide a back packable vacuum system that provides straps and a waist belt consisting of storage pockets for easy access to accessories that may be stowed within them.

Yet another object of the present invention is to provide a back packable vacuum system that consists of an extension tube storage compartment mounted at the rear portion of the device and is easily accessible.

Yet another object of the present invention is to provide a back packable vacuum system that consists of a hose storage compartment that allows the user to stow the vacuum hose while not in use.

Additional objects of the present invention will appear as the description proceeds.

The present invention overcomes the shortcomings of the prior art by providing a back packable vacuum unit that consists of a reusable filter.

In addition, a back packable vacuum system that can be transported anywhere easily without dragging or pulling of the device.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
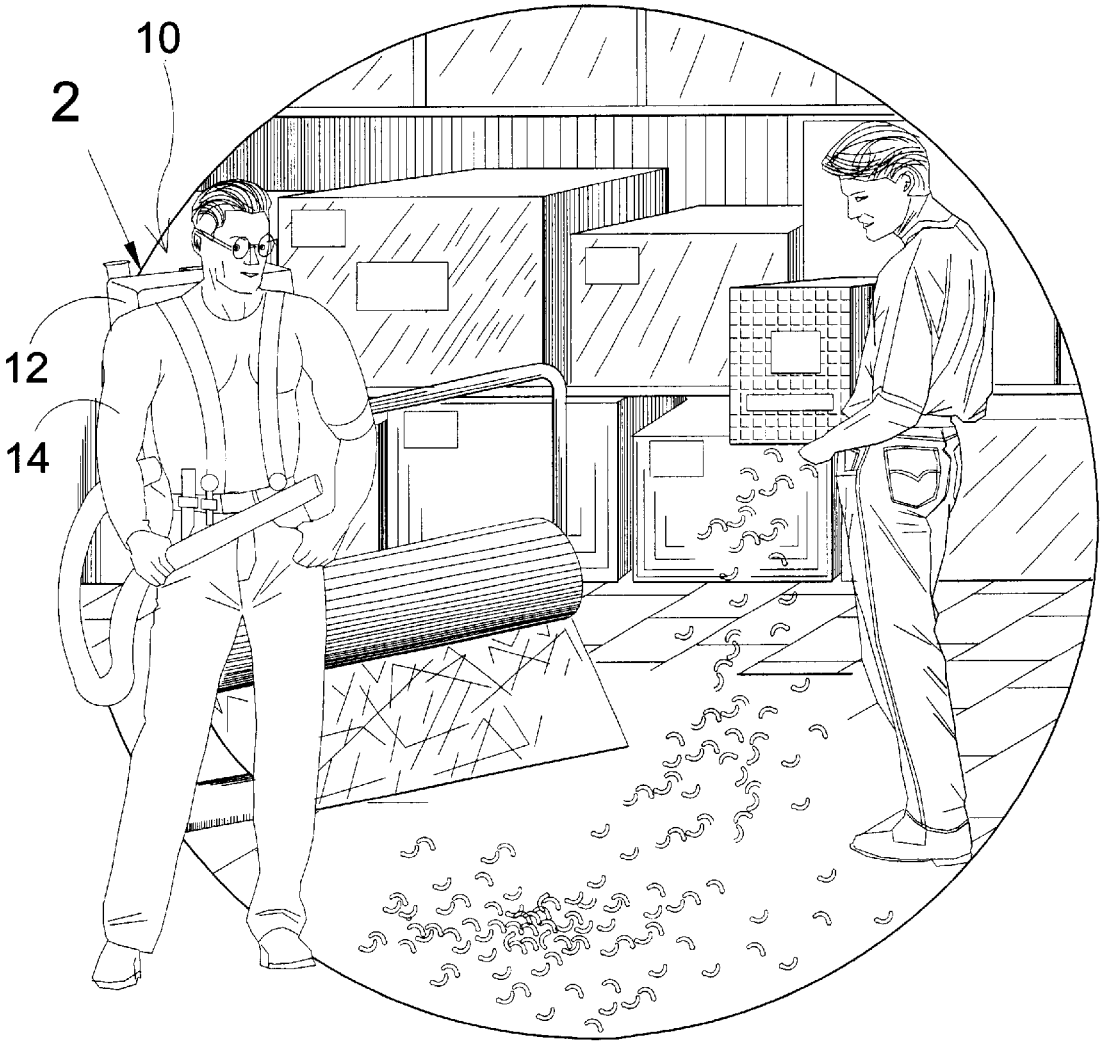
FIG. 1 is an illustrative view of the present invention in use.

With regard to reference numerals used, the following numbering is used throughout the drawings.

10 present invention
12 housing
14 user
16 waist belt
17 buckle
18 pocket
20 attachment
22 shoulder straps
24 handle
26 extension tube storage compartment
28 hose storage compartment
30 hose
32 plastic filter canister
34 locking clips
36 locking clip tab
38 swivel base
38 electrical cord
40 on/off switch
42 filter
44 direction arrow
46 turbine
48 gasket
50 flange

52 recess
54 wall
56 motor
58 air outlets

DETAILED DESCRIPTION OF THE PREFERRED EMBODIMENT(S)

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10 on a user 14. The portable back pack vacuum of the present invention 10 consists of a housing 12 containing vacuum components and is electrically operated and can be carried within a range of twenty-five feet from where the device is plugged in.

Figure 2:
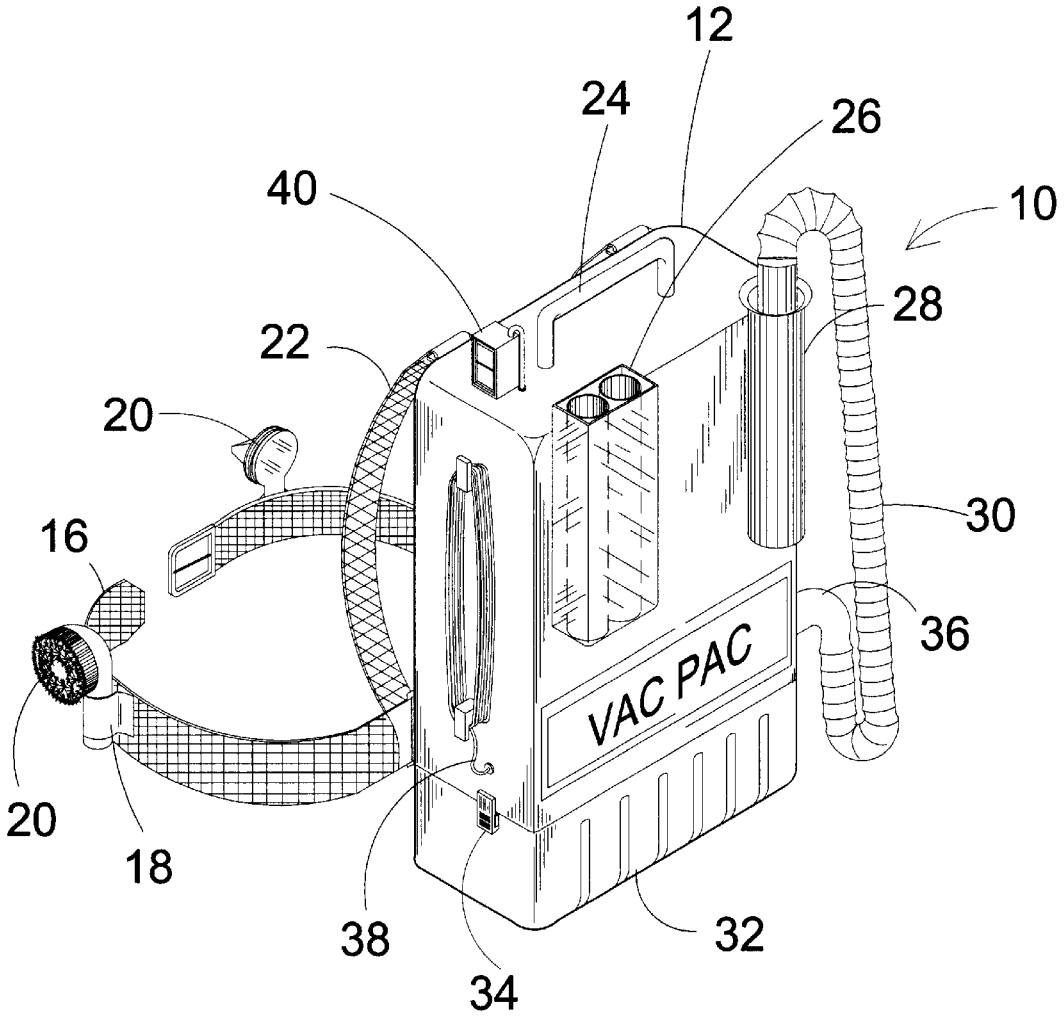
FIG. 2 is a perspective view of the present invention.

Turning to FIG. 2, shown therein is a perspective view of the present invention 10. The portable backpack vacuum of the present invention provides a waist belt 16 with multiple elastic pockets 18 for easy storage and accessibility to items and attachments 20 for the device. The waist belt 16 together with the provided shoulder straps 22 make carrying the device an easy task. A handle 24 located at the top portion of the device housing 12 assists in lifting the pack for mounting. An extension tube storage compartment 26 is also provided, mounted on the rear of the device and is easily accessible. A hose storage compartment 28 allows the user to stow the vacuum hose 30 while not in use. A removable, tinted, transparent, plastic filter canister 32 is provided. It is attached to the upper portion of the device by means of locking clips 34. The canister 32 is removed to access the reusable filter and discard consumption within the canister. The hose 30 is attached to the device at one distal end by means of a swivel base 36. The swivel base 36 allows the hose 30 to rotate in any direction the hose needs to be manipulated. The electrical cord 38 is also shown along with an on/off power switch 40.

Figure 3:
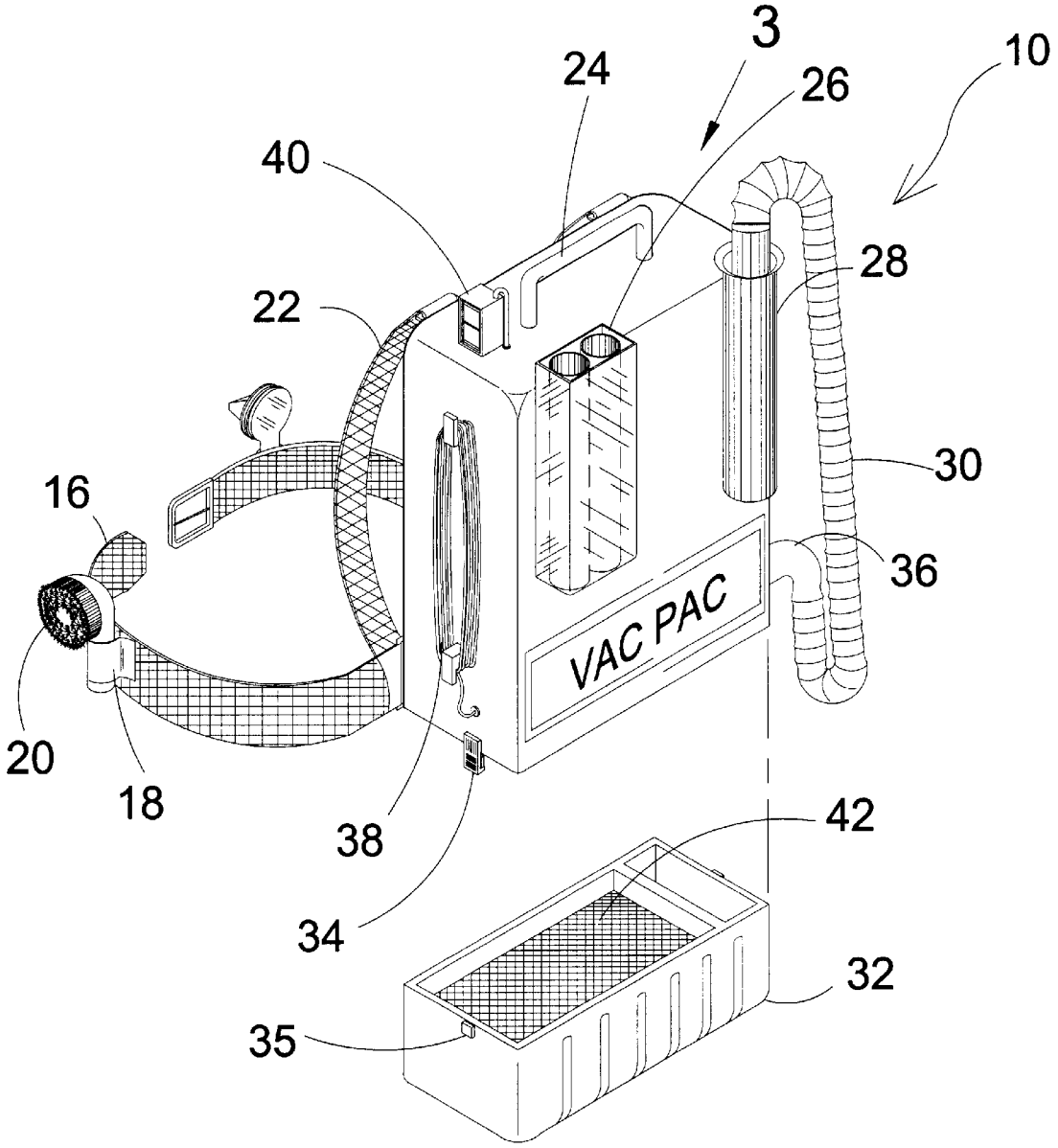
FIG. 3 is a perspective view of the present invention.

Turning to FIG. 3, shown therein is a perspective view of the present invention 10. A removable, tinted or transparent, plastic filter canister 32 is provided at the bottom portion of the device. It is attached to the upper portion of the device by means of locking clip 34 and locking clip tab 35. The canister 32 is removed to access the reusable filter 42 and discard consumption within the canister. Other elements previously disclosed are also shown.

Figure 4:
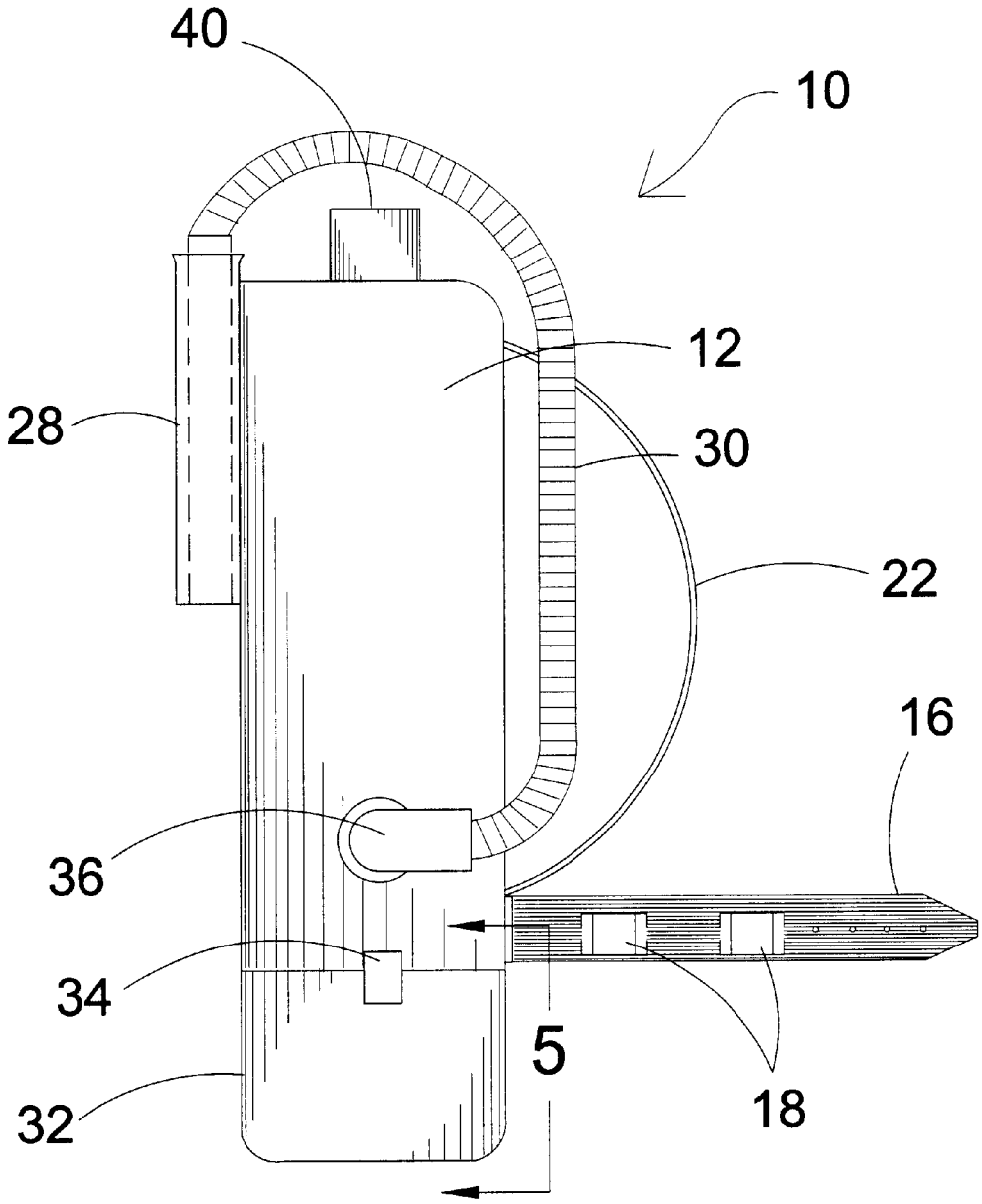
FIG. 4 is a side view of the present invention.

Turning to FIG. 4, shown therein is a side view of the present invention 10. A hose storage compartment 28 is provided and allows the user a place to stow the hose 30 while not in use. The hose 30 is attached to the device at one distal end by means of a swivel base 36. The swivel base 36 allows the hose 30 to rotate in any direction the hose needs to be manipulated. Other elements previously disclosed are also shown.

Figure 5:
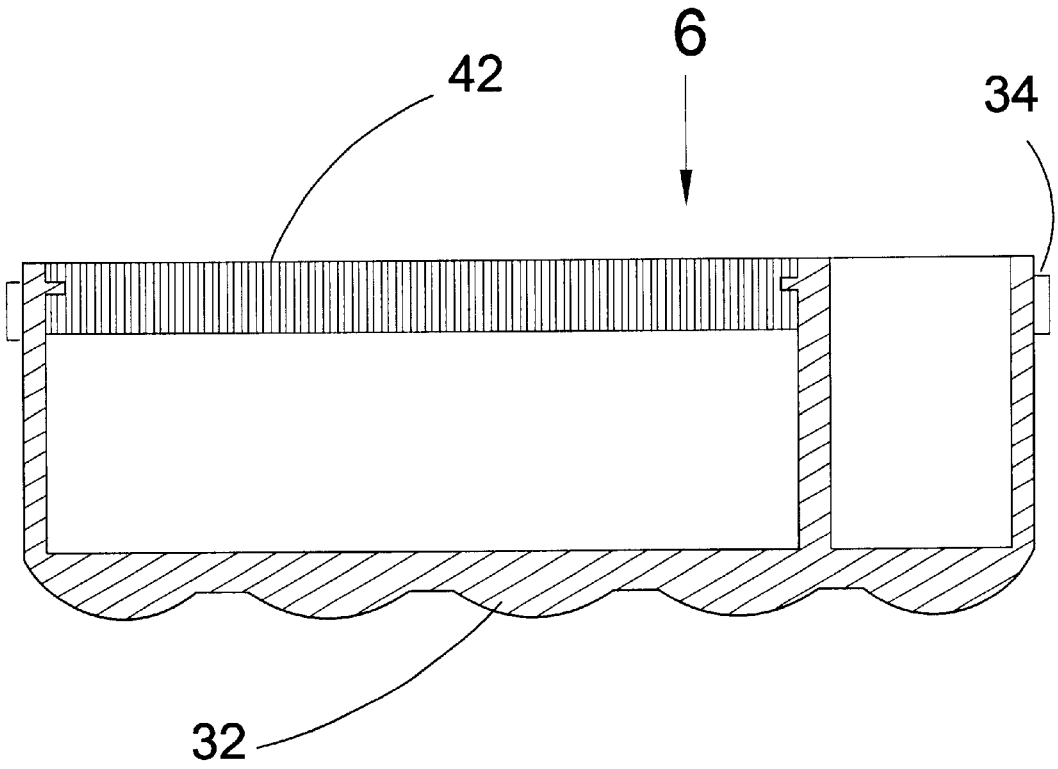
FIG. 5 is a sectional view of the present invention.

Turning to FIG. 5, shown therein is a sectional view of the present invention. A removable, tinted or transparent, plastic filter canister 32 is provided at the bottom portion of the device by means of locking clips 34. The canister is removed to access the reusable filter 42 and disposal of consumption within the canister.

Figure 6:
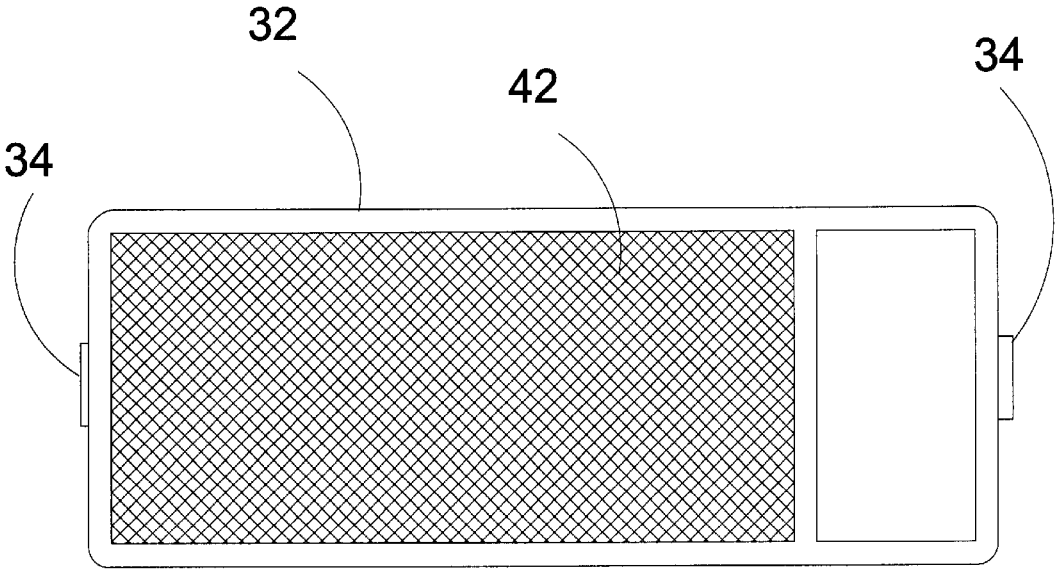
FIG. 6 is a top view of the filter canister of the present invention.

Turning to FIG. 6, shown therein is a sectional view of the present invention. A removable, tinted or transparent, plastic filter canister 32 is provided at the bottom portion of the device by means of locking clips 34. The canister is removed to access the reusable filter 42 and disposal of consumption within the canister.

Figure 7:
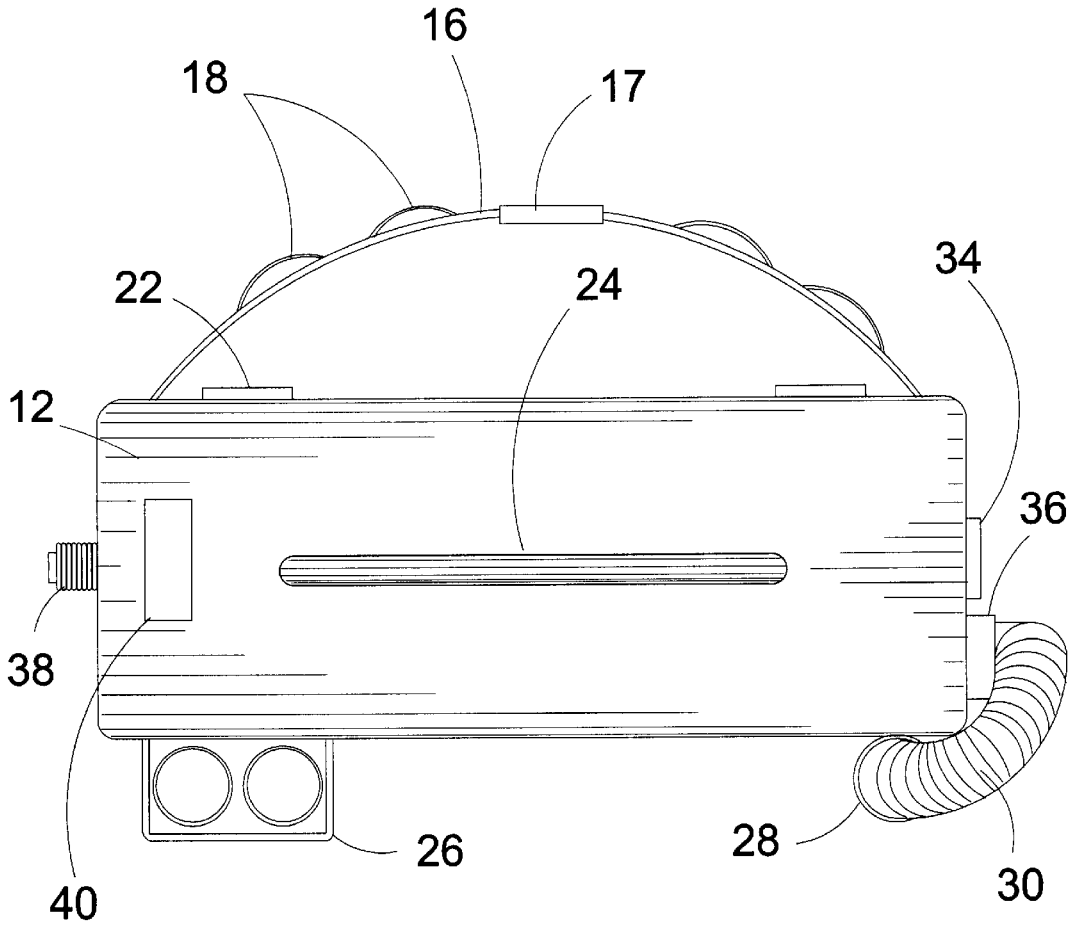
FIG. 7 is a top view of the present invention.

Turning to FIG. 7, shown therein is a top view of the present invention 10. The portable back pack vacuum of the present invention consists of a housing 12 containing vacuum components and is electrically operated and can be carried within a range of twenty five feet from where the device is plugged in. Shoulder straps 22 and a waist belt 16 with buckle 17 are provided for easy maneuvering of the device. An extension tube storage compartment 26 is also provided, mounted on the rear of the device and is easily accessible. A hose storage compartment 28 allows the user to stow the vacuum hose 30 while not in use. Other elements previously disclosed are also shown.

Figure 8:
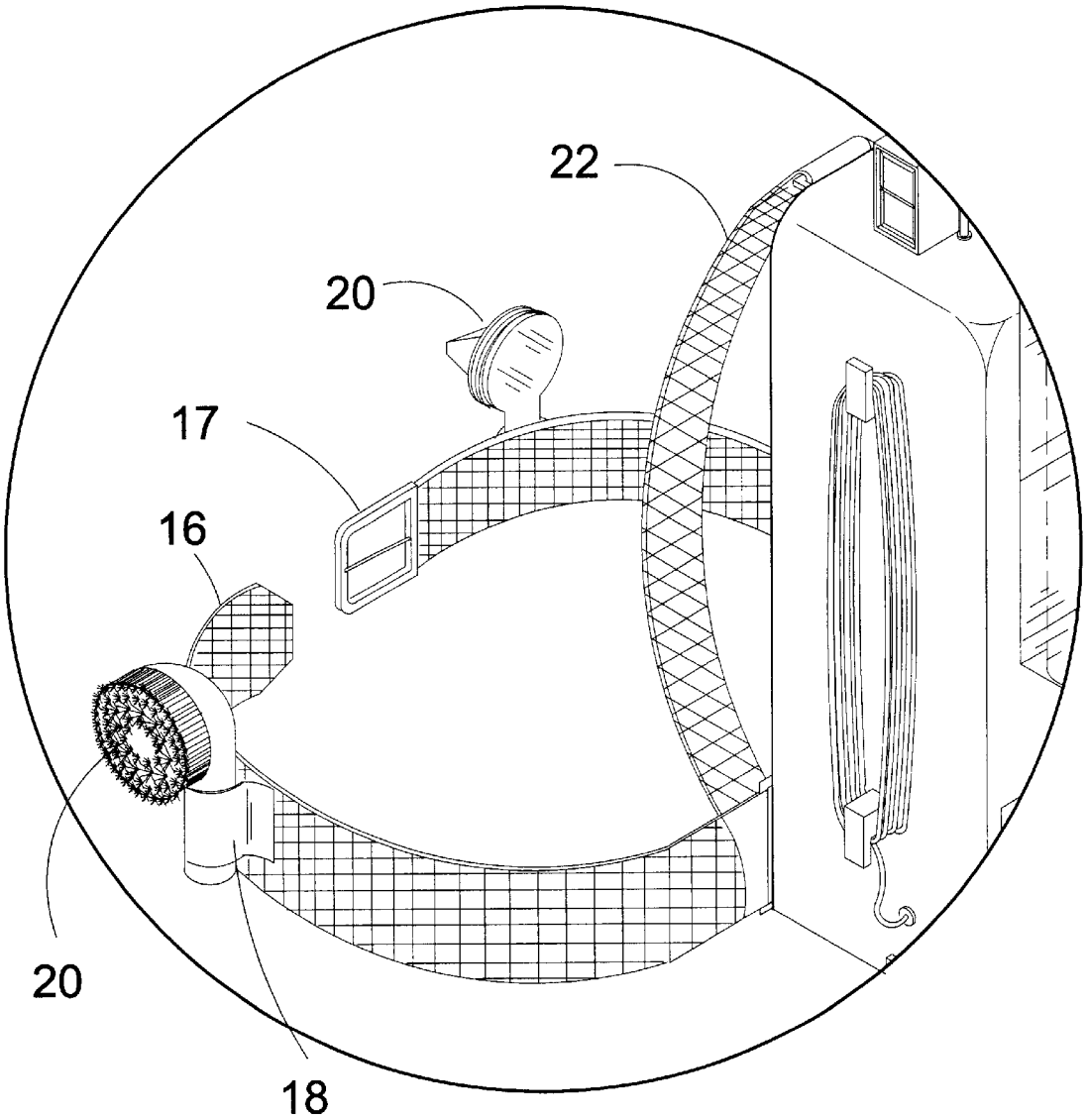
FIG. 8 is a detail view of the strap and waist belt of the present invention.

Turning to FIG. 8, shown therein is a detail view of the shoulder strap 22 and waist belt 16 of the present invention in use. Shoulder 22 and a waist belt 16 with buckle 17 are provided for easy maneuvering of the device. Elastic pockets 18 are located on the outer portion of the belt provide storage for accessories 20.

Figure 9:
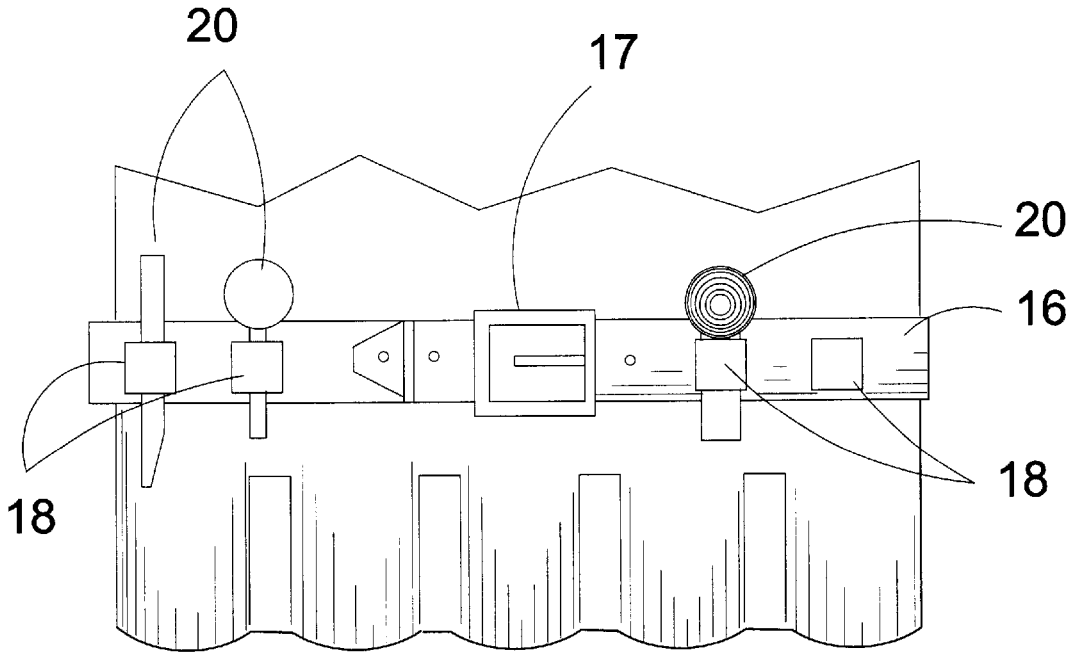
FIG. 9 is a partial view of the waist belt of the present invention.

Turning to FIG. 9, shown therein is a partial view of the waist belt of the present invention. A waist belt 16 with buckle 17 is provided for easy maneuvering of the device. Elastic pockets 18 are located on the outer portion of the belt provide storage for accessories 20.

Figure 10:
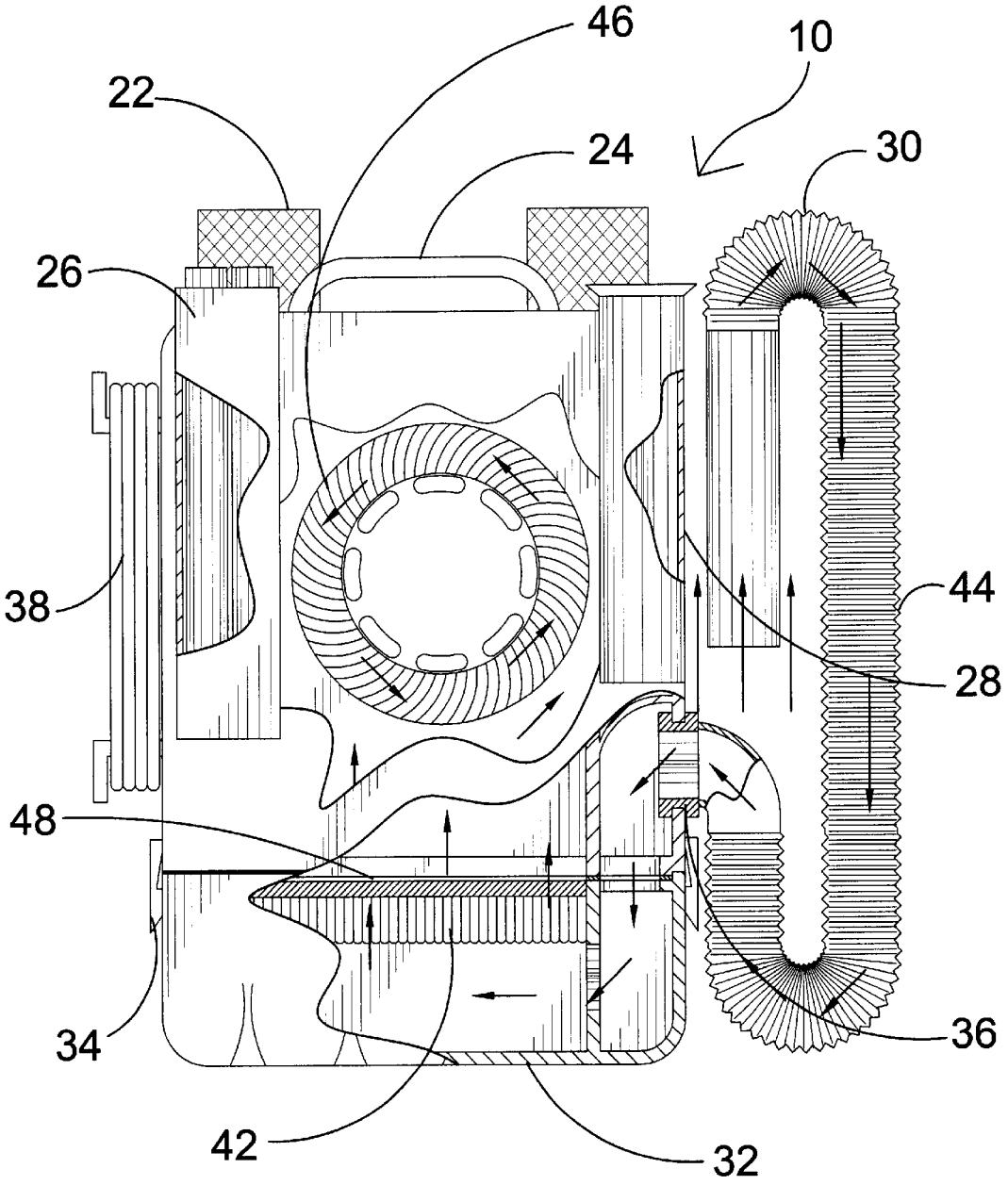
FIG. 10 is a cut away view of the present invention.

Turning to FIG. 10, shown therein is a cut away view of the present invention 10. Shown is a cut away view of the present invention showing with direction arrows 44 how air is draw into the present invention through the hose 30 where it is then directed past the swivel joint 36 then through a filter 42 where then the air is finally draw in and expelled out through the vacuum turbine 16. A gasket 48 is also shown along with other elements previously disclosed.

Figure 11:
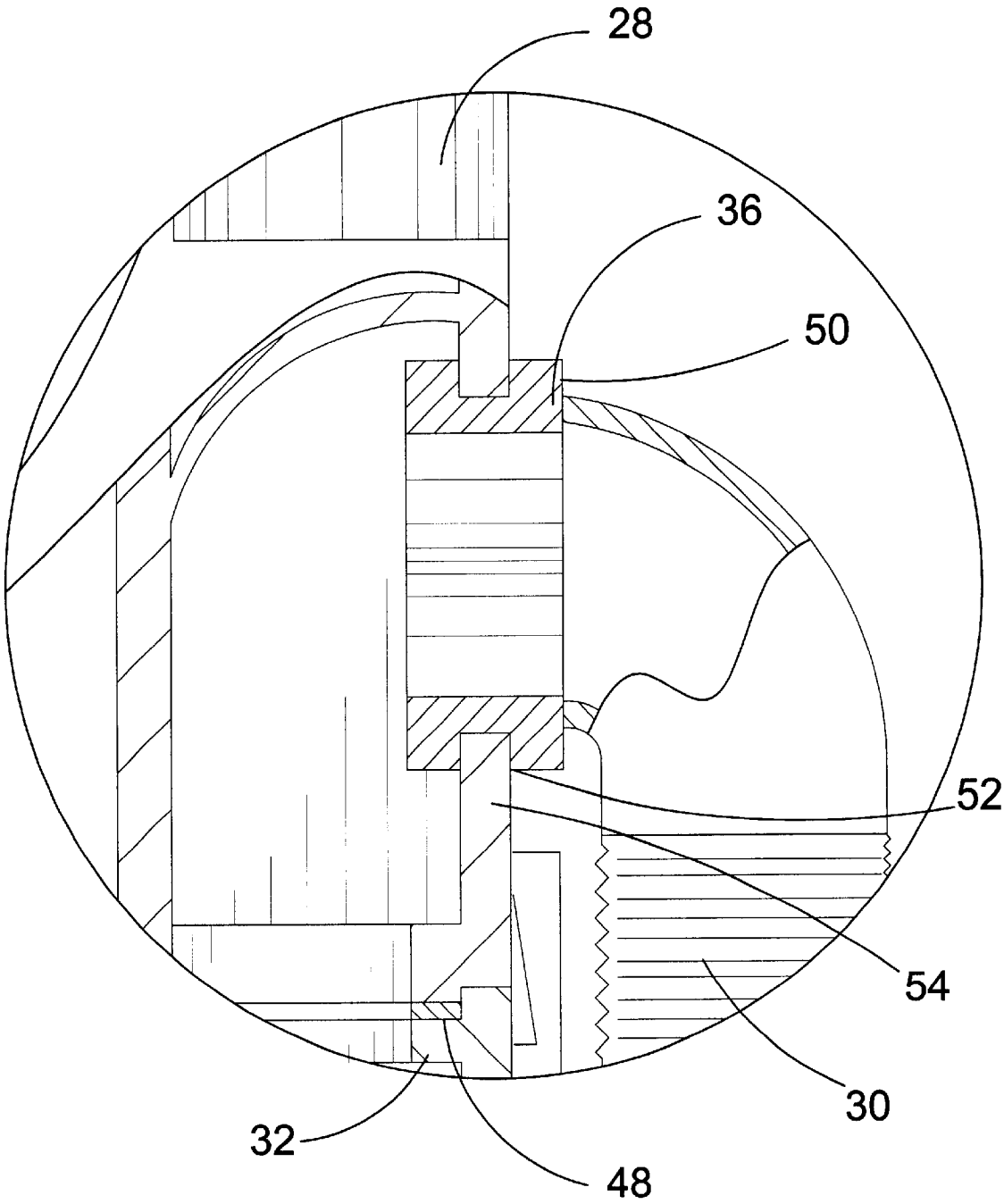
FIG. 11 is a detailed cut away view of the present invention.

Turning to FIG. 11, shown therein is a detailed cut away of the present invention. Shown is the swivel joint 36 of the present invention having a structure that allows the hose 30 to swivel while maintaining a vacuum seal. The swivel 30 has an outer flange 50 having a recess 52 therein for receiving a wall 54 portion of the housing 12. Other elements previously disclosed are also shown.

Figure 12:
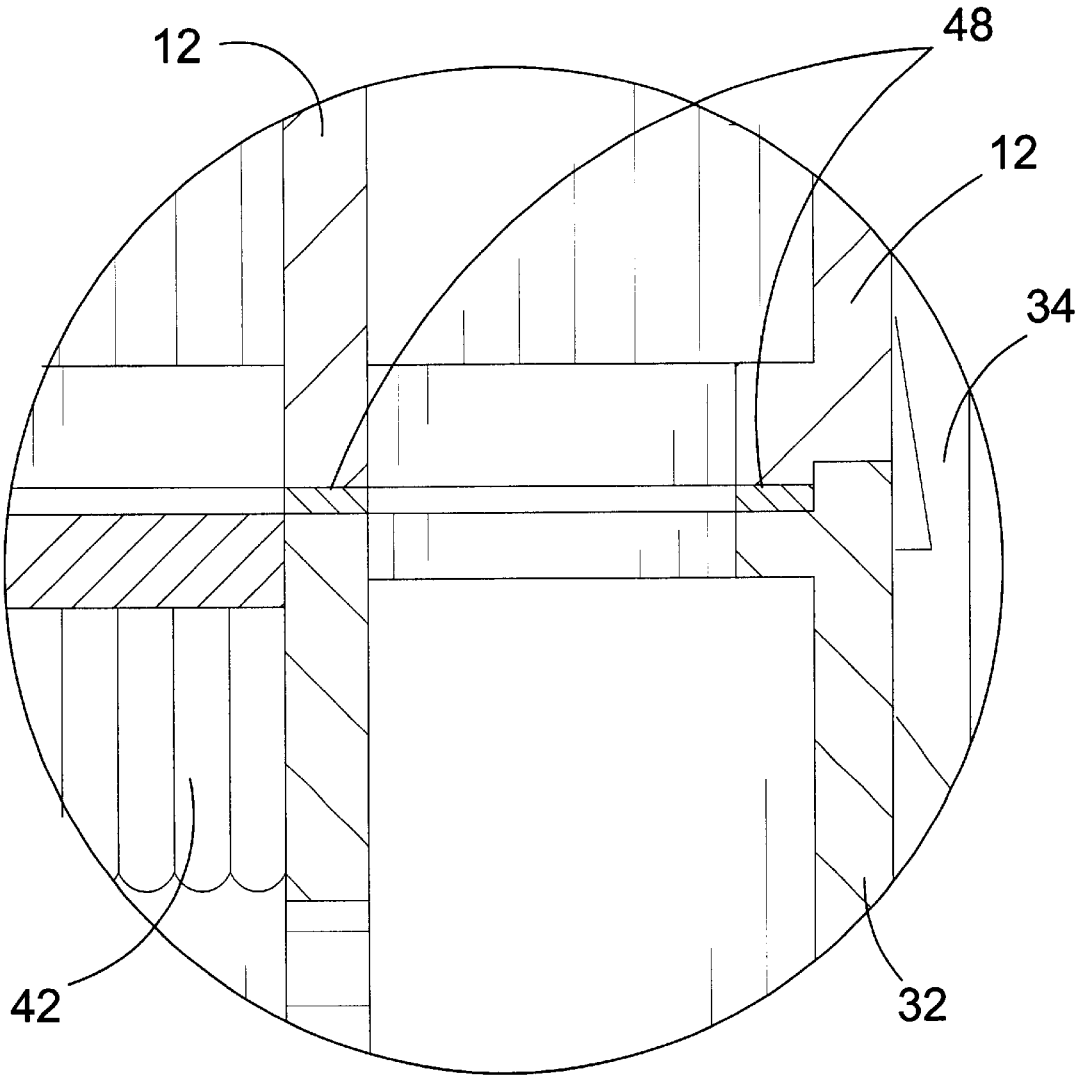
FIG. 12 is a detailed cut away view of the present invention.

Turning to FIG. 12, shown therein is a detailed cut away view of the present invention. Shown is the gasket 48 of the present invention in place between the junction where the filter canister 32 and vacuum housing 12 meet so that an air tight seal when the locking clips 34 are engaged can be produced, to prevent external air pressure from entering the vacuum from other means than the hose. The filter 42 is also shown.

Figure 13:
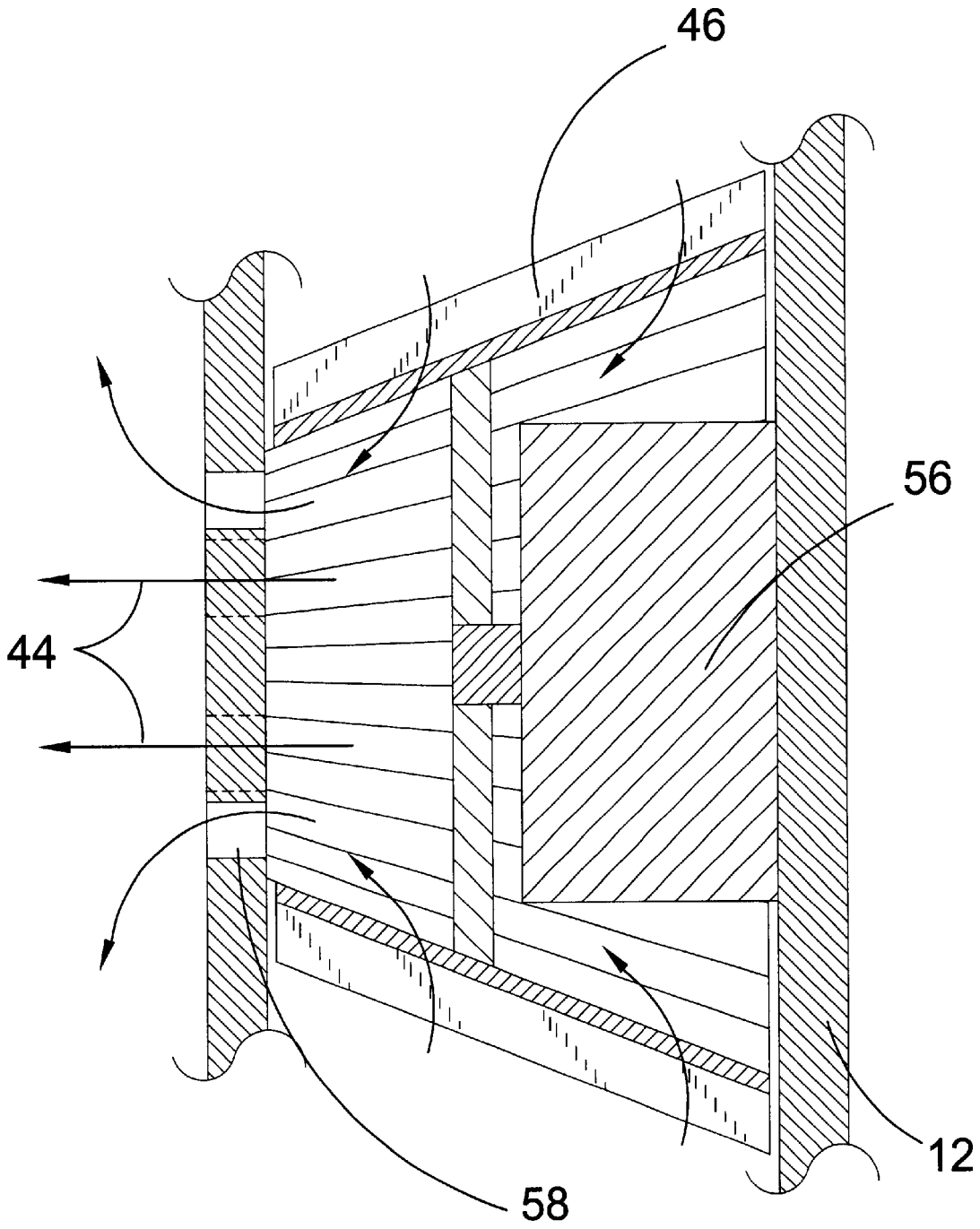
FIG. 13 is a sectional view of the present invention.

Turning to FIG. 13, shown therein is a sectional view of the present invention. Shown is the motor 56 and vacuum turbines 46 interior where then pressure built up in the turbine is released through the air outlets 58, thereby creating an air flow shown by arrows 44 that produces a vacuum within the vacuum housing 12.

What is claimed to be new and desired to be protected by Letters Patent is set forth in the appended claims:

We claim:

1. An apparatus for a vacuum for debris to be worn on the back of a user, comprising:

a) a housing, said housing being generally rectangular, said housing having a top end and a bottom end, a front and a rear, a pair of sides, and an upper portion and a lower portion;

b) means for removably mounting said housing onto the back of the user;

c) a vacuum disposed internally of said housing;

d) a hose disposed on said housing, said hose connected to and for use with said vacuum;

e) a canister disposed on said lower portion of said housing for receiving and storing therein the debris picked up by the vacuum;

f) a filter disposed internally of said canister for filtering the debris picked up by the vacuum;

g) a handle-disposed on said top end of said housing for picking up the housing;

h) said means for removably mounting said housing further comprising a waist strap and a pair of shoulder straps;

i) a buckle disposed on said waist strap for removably connecting said waist strap; and j) a plurality of pockets disposed on said waist strap, said pockets for receiving attachments for use with said hose.

2. The apparatus of claim 1, wherein said pockets are made of elastic.

3. The apparatus of claim 2, further comprising multiple hose extension members for extending the length of said hose.

4. The apparatus of claim 3, further comprising a first storage compartment disposed on said rear of said housing for receiving said hose extension members, said first storage compartment sized to receive said hose extension members.

5. The apparatus of claim 4, further comprising a second storage compartment disposed on said rear of said housing for receiving an end of said hose, said second storage compartment sized to receive an end of said hose.

6. The apparatus of claim 5, further comprising a swivel base for connecting said hose to said housing.

7. The apparatus of claim 6, wherein said swivel base further comprises a flange disposed on an end of said hose, said flange having a recess disposed in the periphery thereof, said recess for receiving a wall of said housing for the flange to rotate therein said wall of said housing.

8. The apparatus of claim 7, wherein said vacuum further comprises an electric turbine disposed internally of said housing for providing a vacuum, an air intake into said turbine, and at least one air outlet for said turbine.

9. The apparatus of claim 8, further comprising an on/off switch for said turbine, said on/off switch disposed on said housing.

10. The apparatus of claim 9, further comprising an electric cord connected to and for use with said electric turbine, said cord having means for mounting said cord disposed on said housing.

11. The apparatus of claim 10, further comprising a pair of attachment clips for removably attaching said canister to said housing.

12. The apparatus of claim 11, further comprising a gasket disposed between said canister and said housing for providing a substantially airtight seal therebetween.

13. The apparatus of claim 12, wherein said canister is made of transparent material so that its contents can be viewed by the user.

* * * * *